US011400481B2

(12) United States Patent
Ikushima

(10) Patent No.: US 11,400,481 B2
(45) Date of Patent: Aug. 2, 2022

(54) LIQUID DISCHARGE DEVICE, APPLICATION DEVICE WITH SAID DISCHARGE DEVICE, AND APPLICATION METHOD

(71) Applicant: MUSASHI ENGINEERING, INC., Mitaka (JP)

(72) Inventor: Kazumasa Ikushima, Tokyo (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 389 days.

(21) Appl. No.: 16/468,947

(22) PCT Filed: Dec. 19, 2017

(86) PCT No.: PCT/JP2017/045580
§ 371 (c)(1),
(2) Date: Jun. 12, 2019

(87) PCT Pub. No.: WO2018/117113
PCT Pub. Date: Jun. 28, 2018

(65) Prior Publication Data

US 2020/0078817 A1 Mar. 12, 2020

(30) Foreign Application Priority Data

Dec. 22, 2016 (JP) ..... JP2016-248782

(51) Int. Cl.
*B05C 9/10* (2006.01)
*B05D 1/26* (2006.01)
*B05C 5/02* (2006.01)

(52) U.S. Cl.
CPC ..... *B05C 5/0225* (2013.01); *B05C 9/10* (2013.01); *B05D 1/26* (2013.01)

(58) Field of Classification Search
CPC ..... B05D 1/26; B05C 5/0229
See application file for complete search history.

(56) References Cited

U.S. PATENT DOCUMENTS 6,365,226 B1 * 4/2002 Wu ..... B05C 5/0216 123/337
2006/0157517 A1 * 7/2006 Fiske ..... H05K 13/046 222/504

(Continued)

FOREIGN PATENT DOCUMENTS

CN 203170518 U 9/2013
CN 104466036 A 3/2015

(Continued)

OTHER PUBLICATIONS

Jo.Liquid crystal injecting appartus for liquid. KR9502287. Mar. 1995 (Year: 1995).*

(Continued)

*Primary Examiner* — Cachet I Proctor
(74) *Attorney, Agent, or Firm* — WHDA, LLP

(57) ABSTRACT

A liquid discharge device to discharge a liquid material stirred near a metering chamber, an application device and an application method using the application device. A liquid discharge device includes a storage unit including a storage container storing a liquid material, and a stirrer drive mechanism; a discharge unit including a metering chamber to be filled with the liquid material, a plunger sliding in close contact with an inner peripheral surface of the metering chamber, a nozzle in communication with the metering chamber, and a switching valve between a first position at which the storage container and the metering chamber are communicated with each other, and a second position at which the metering chamber and the nozzle are communicated; and a connection flow path through which the storage container and the metering chamber are communicated, The stirrer drive mechanism is separable from the storage unit.

21 Claims, 13 Drawing Sheets

(56) References Cited

U.S. PATENT DOCUMENTS

| | | | | |
|---|---|---|---|---|
| 2007/0109236 | A1* | 5/2007 | Yamada | G02F 1/133371 345/87 |
| 2010/0156970 | A1* | 6/2010 | Ikushima | B05C 5/02 347/8 |
| 2010/0294810 | A1* | 11/2010 | Ikushima | B05C 11/1034 222/309 |
| 2014/0346253 | A1* | 11/2014 | Ikushima | B05C 5/0212 239/337 |
| 2016/0336543 | A1 | 11/2016 | Quan et al. | |
| 2018/0264506 | A1* | 9/2018 | Ikushima | B05C 5/02 |

FOREIGN PATENT DOCUMENTS

| | | | | |
|---|---|---|---|---|
| JP | 61-217739 | A | 9/1986 | |
| JP | 11-47658 | A | 2/1999 | |
| KR | 9502287 | B1 * | 3/1995 | |
| KR | 10-0621905 | B1 | 9/2006 | |
| WO | 2008/146464 | A1 | 12/2008 | |
| WO | 2009/104421 | A1 | 8/2009 | |
| WO | WO-2009104421 | A * | 8/2009 | B05C 11/1015 |
| WO | WO-2009104421 | A1 * | 8/2009 | B05C 11/1034 |
| WO | 2016/117437 | A1 | 7/2016 | |

OTHER PUBLICATIONS

Supplementary Search Report dated Aug. 28, 2020, issued in counterpart EP Application No. 17 88 3339 (1 page).

International Search Report issued in counterpart International Application No. PCT/JP2017/045580. (2 pages).

English translation of International Preliminary Report on Patentability issued in counterpart International Application Mo. PCT/JP2017/045580. (5 pages).

Office Action dated Dec. 1, 2020, issued in counterpart CN Application No. 201780079678.5, with English Translation. (10 pages).

* cited by examiner

[Fig.1]
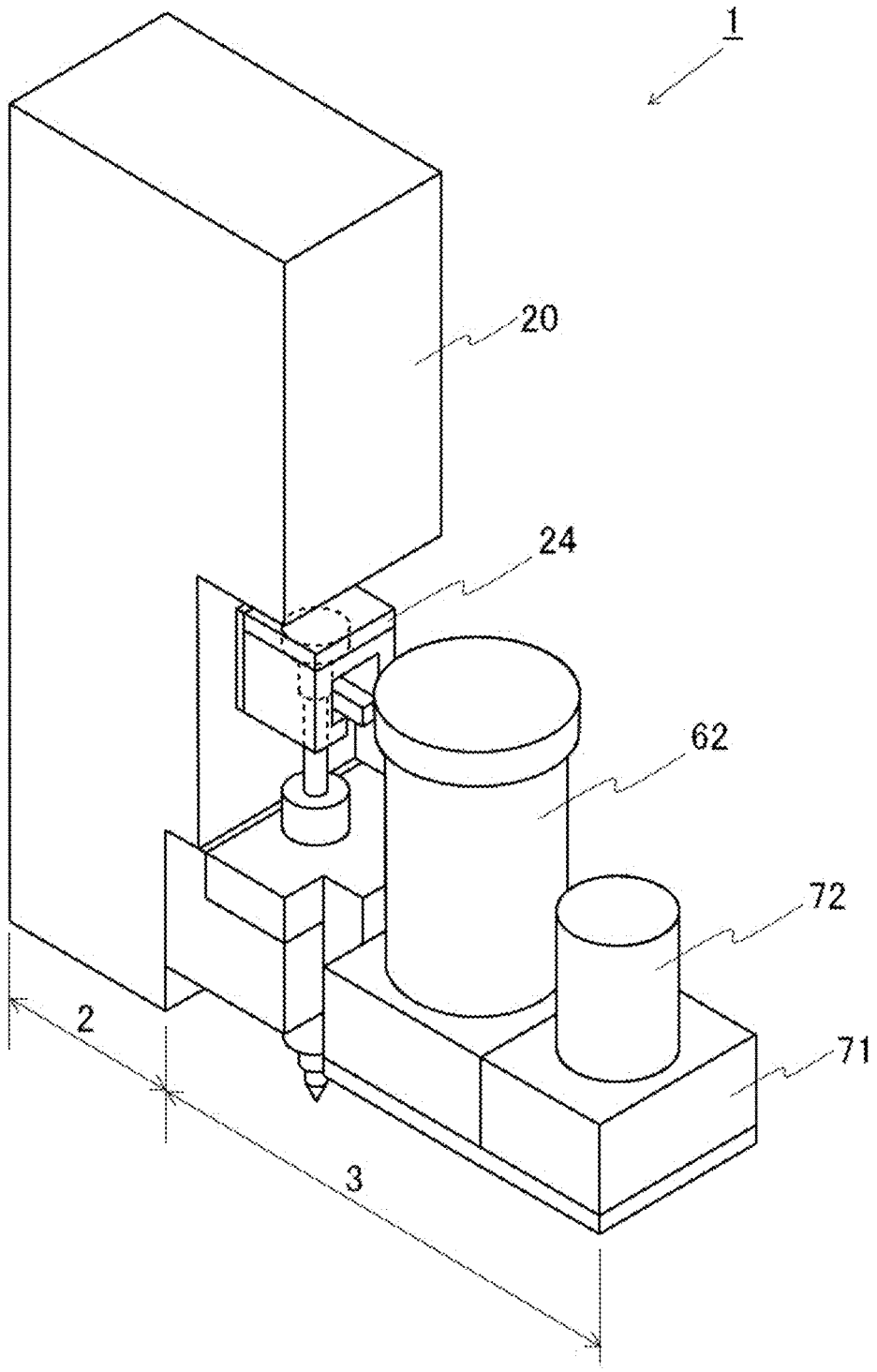

[Fig.2]
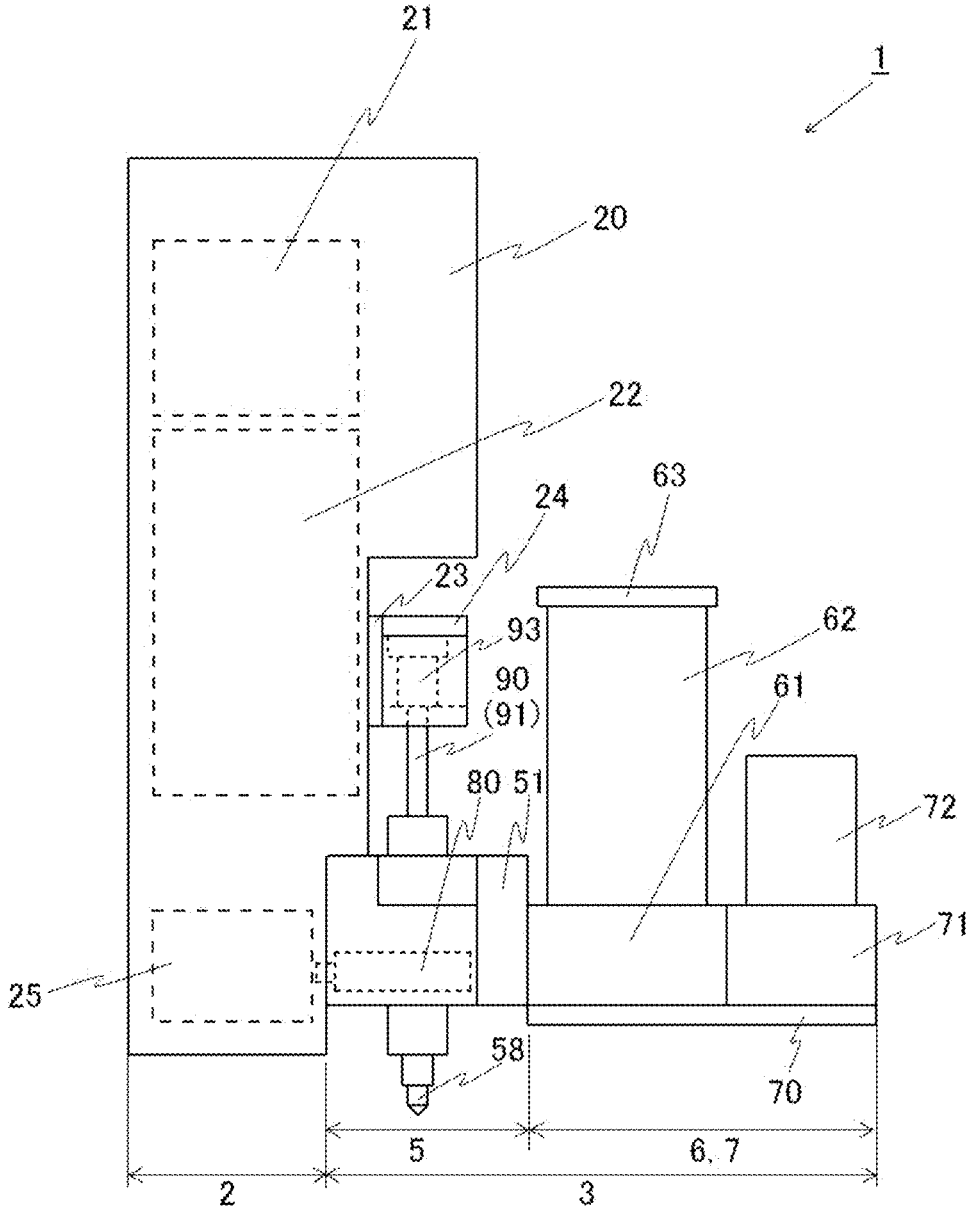

[Fig.3]
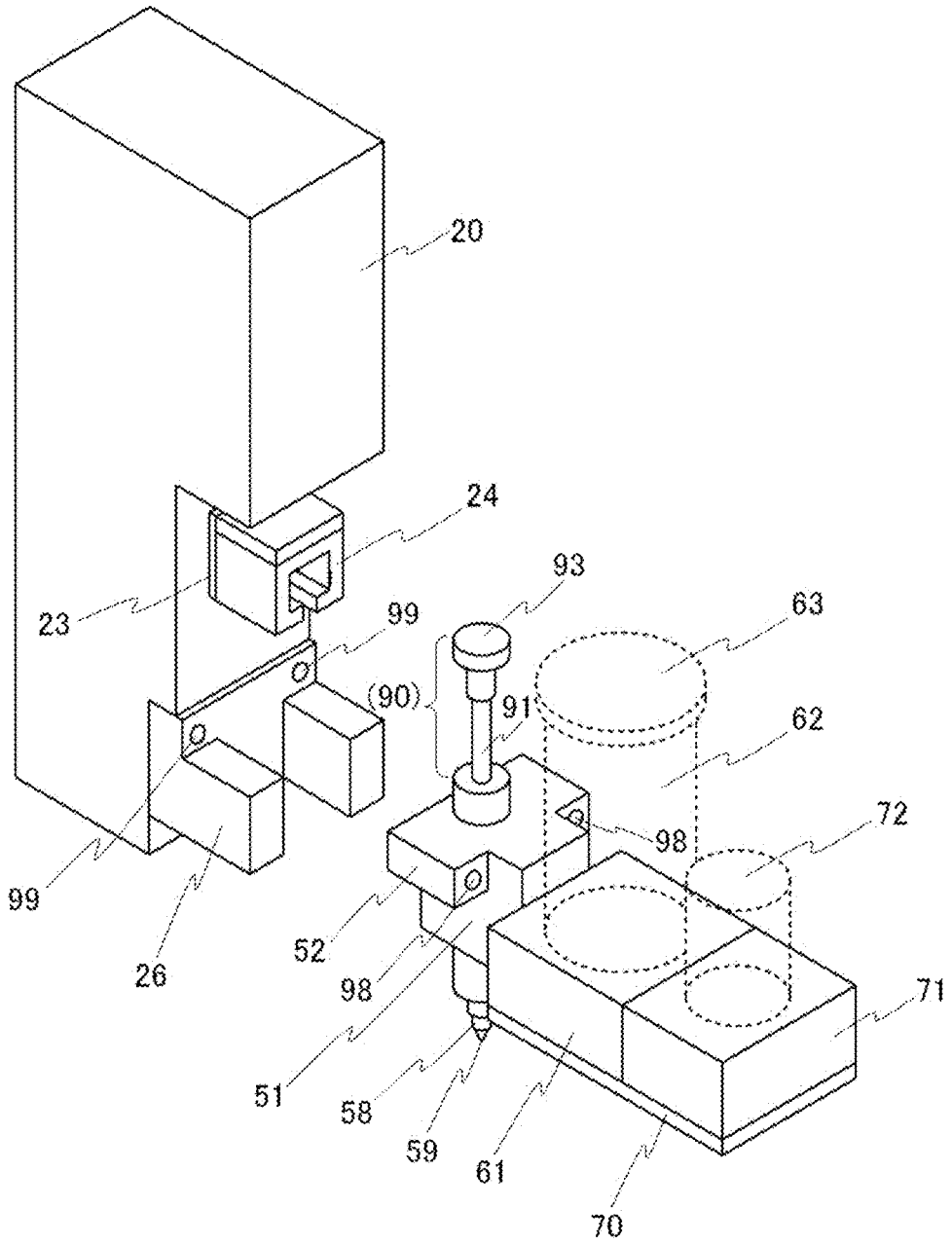

[Fig.4]
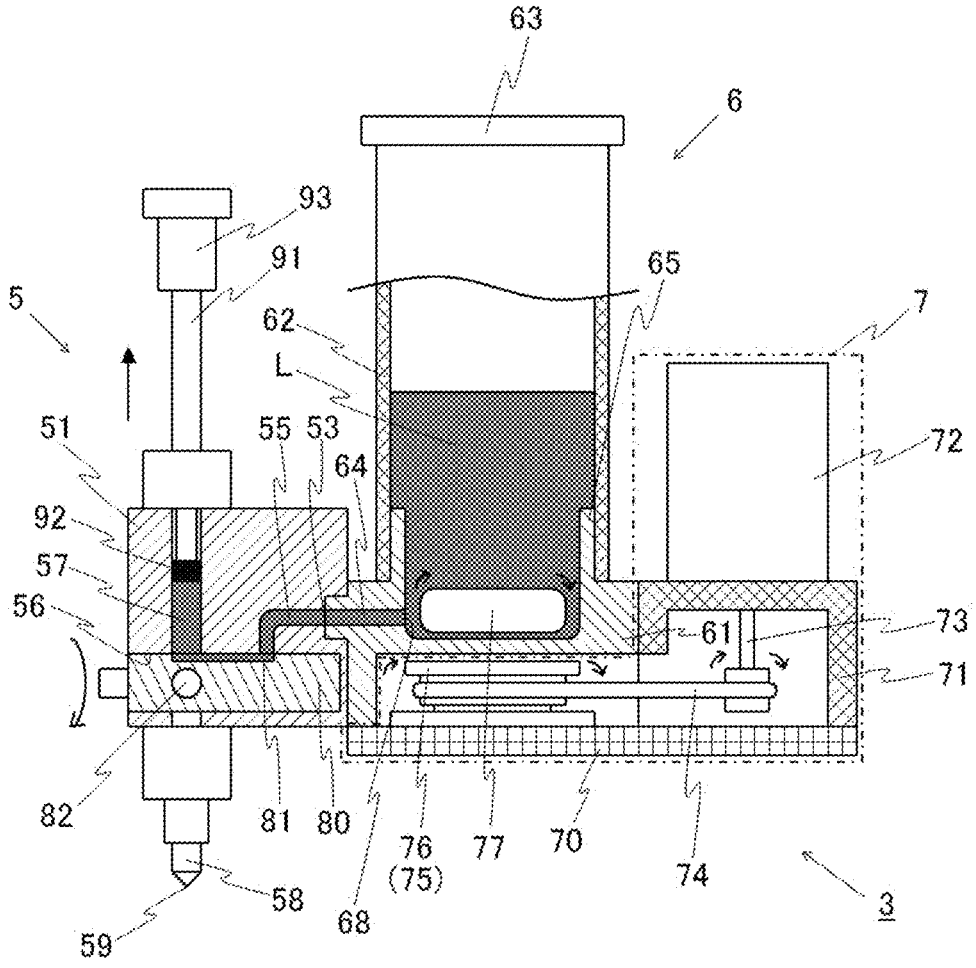

[Fig.5]
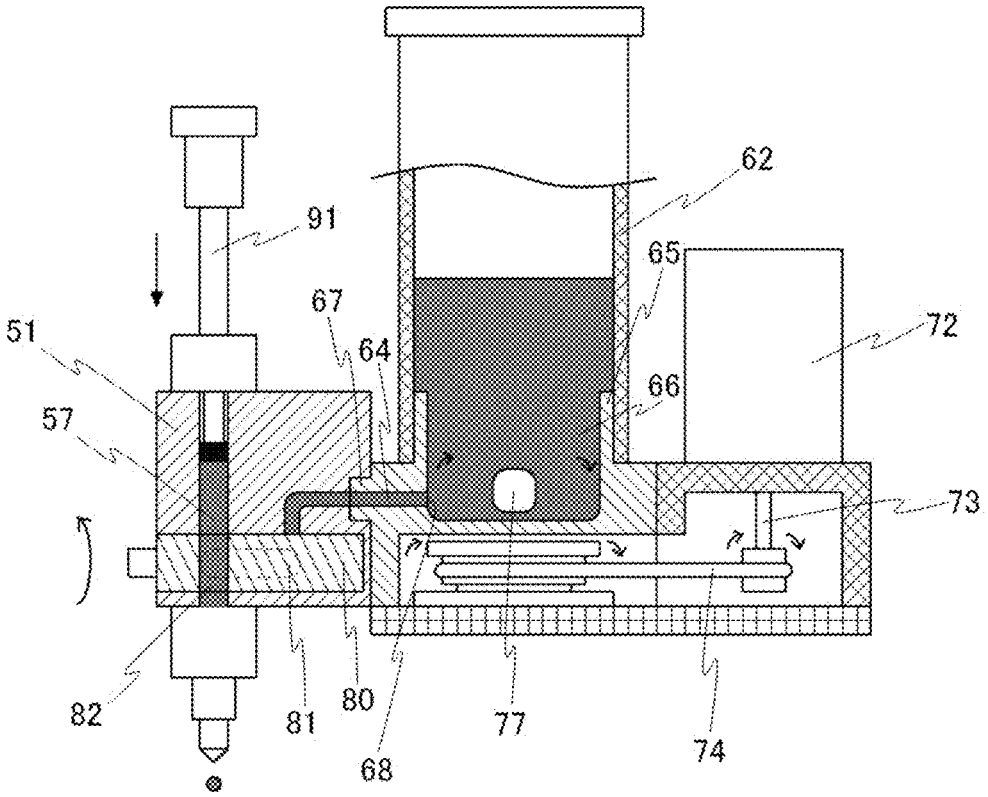

[Fig.6]
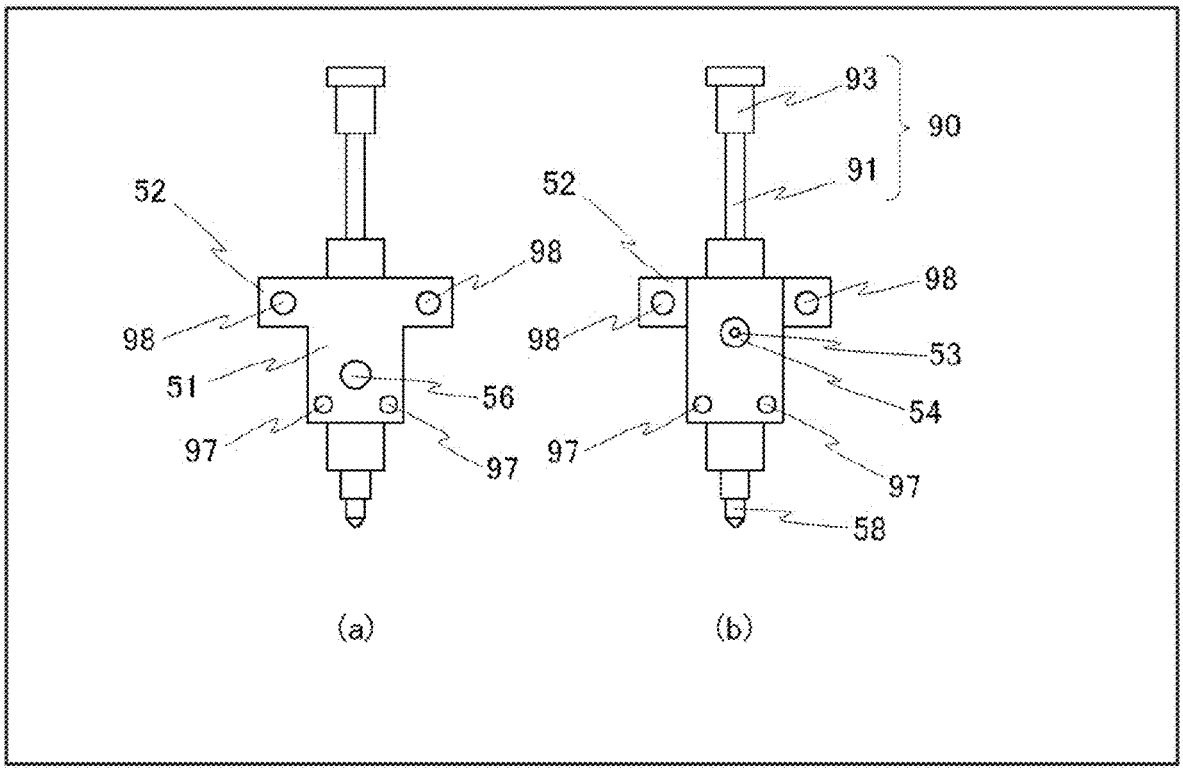

[Fig.7]
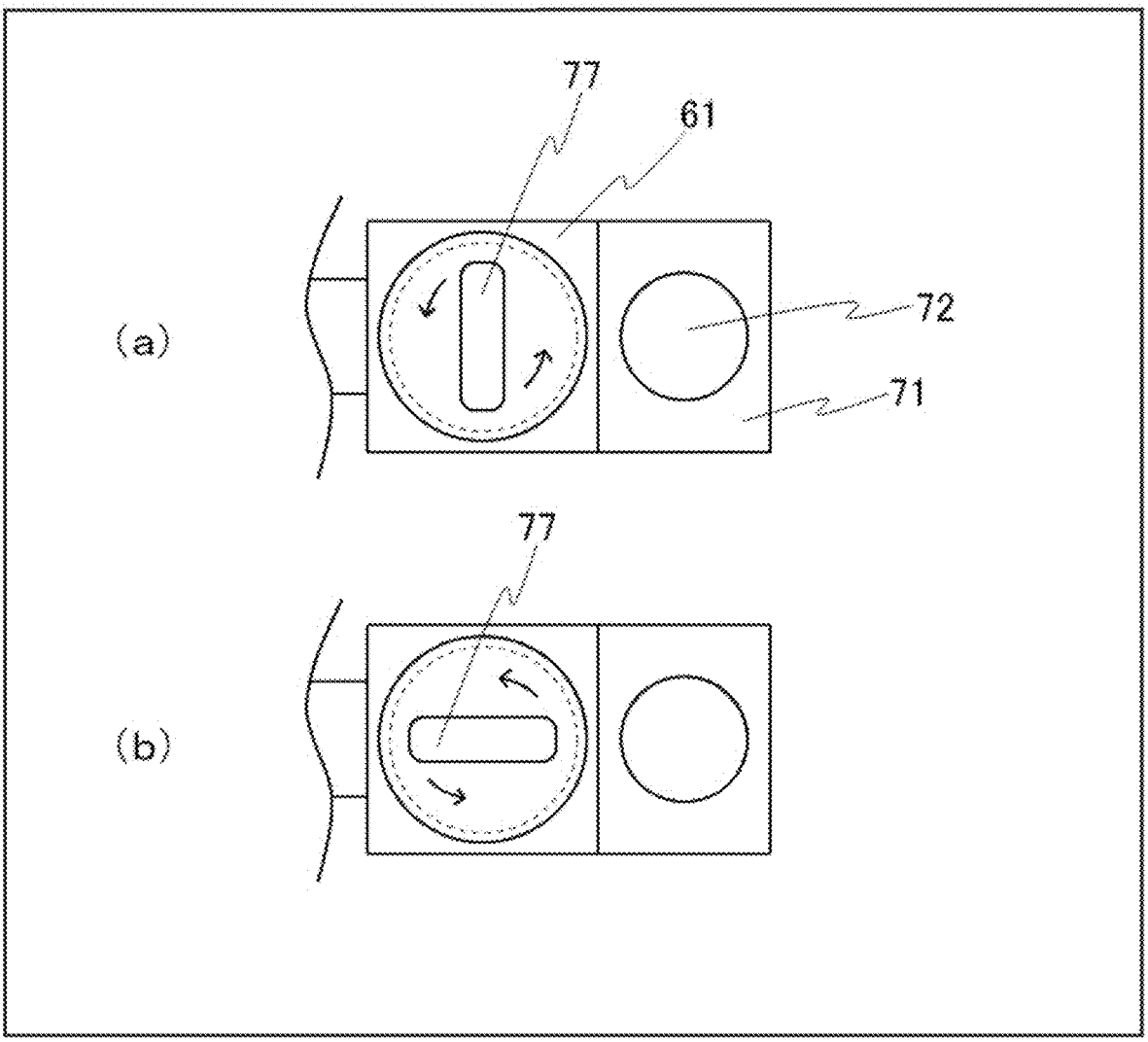

[Fig.8]
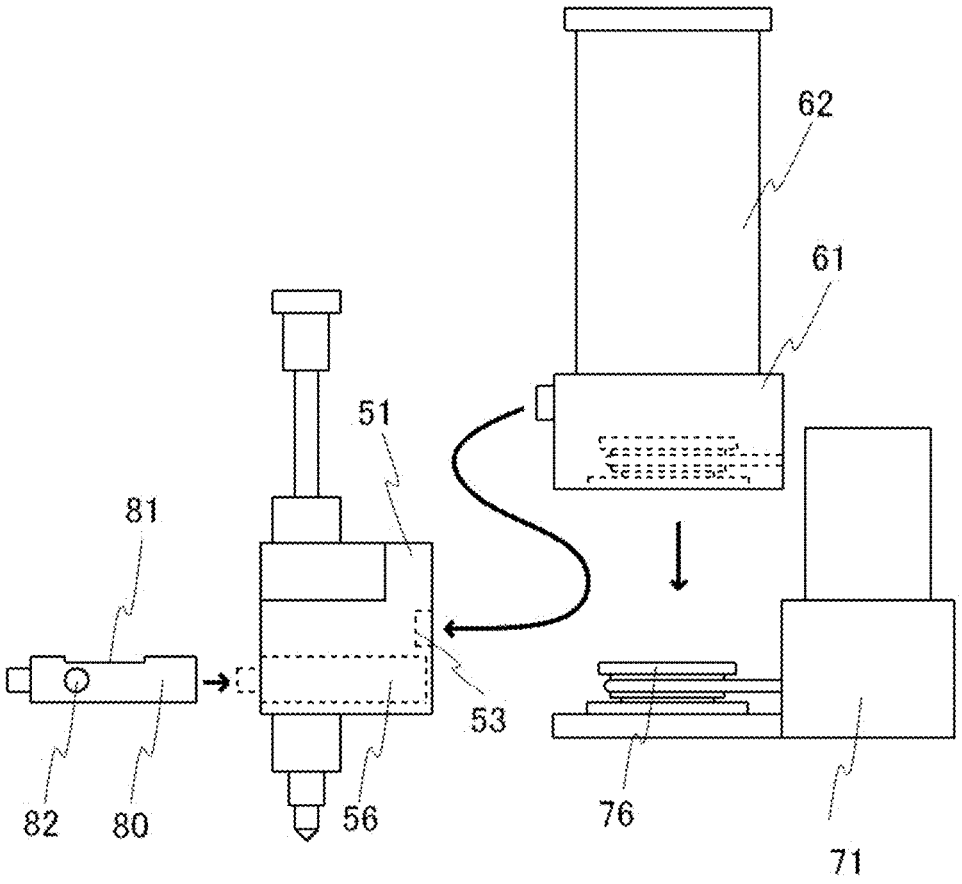

[Fig.9]
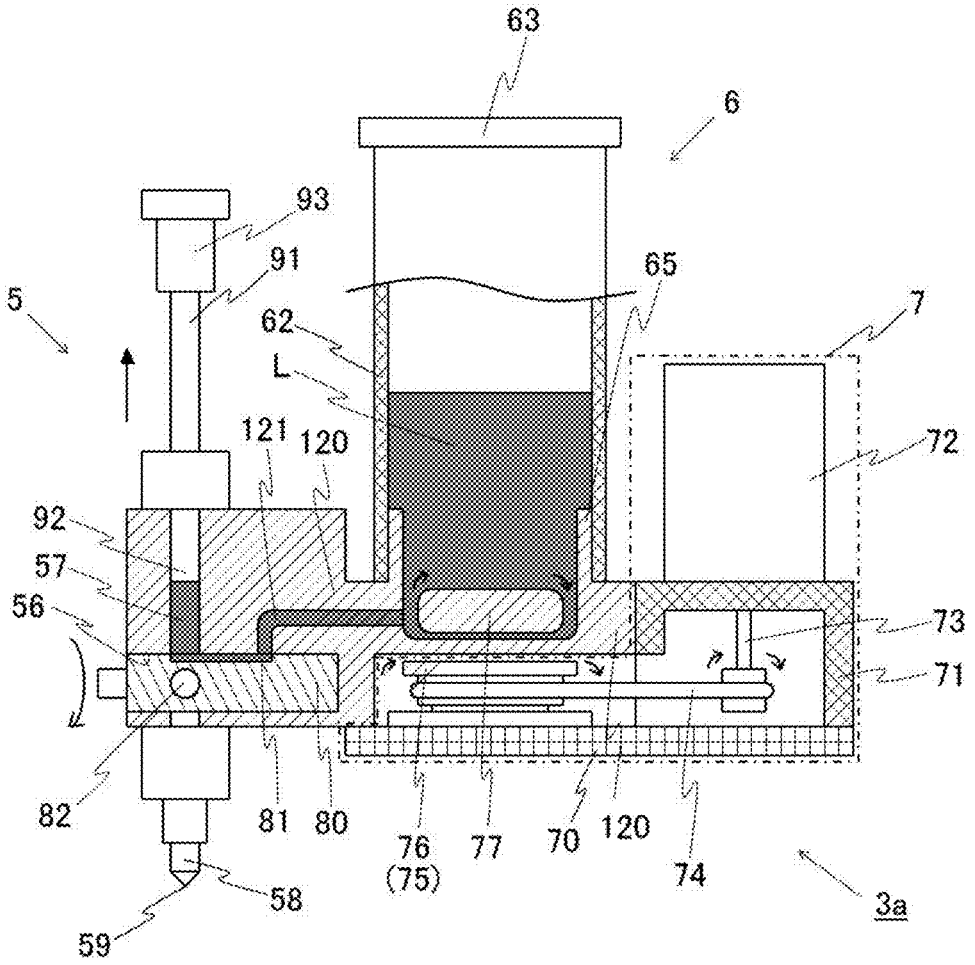

[Fig.10]
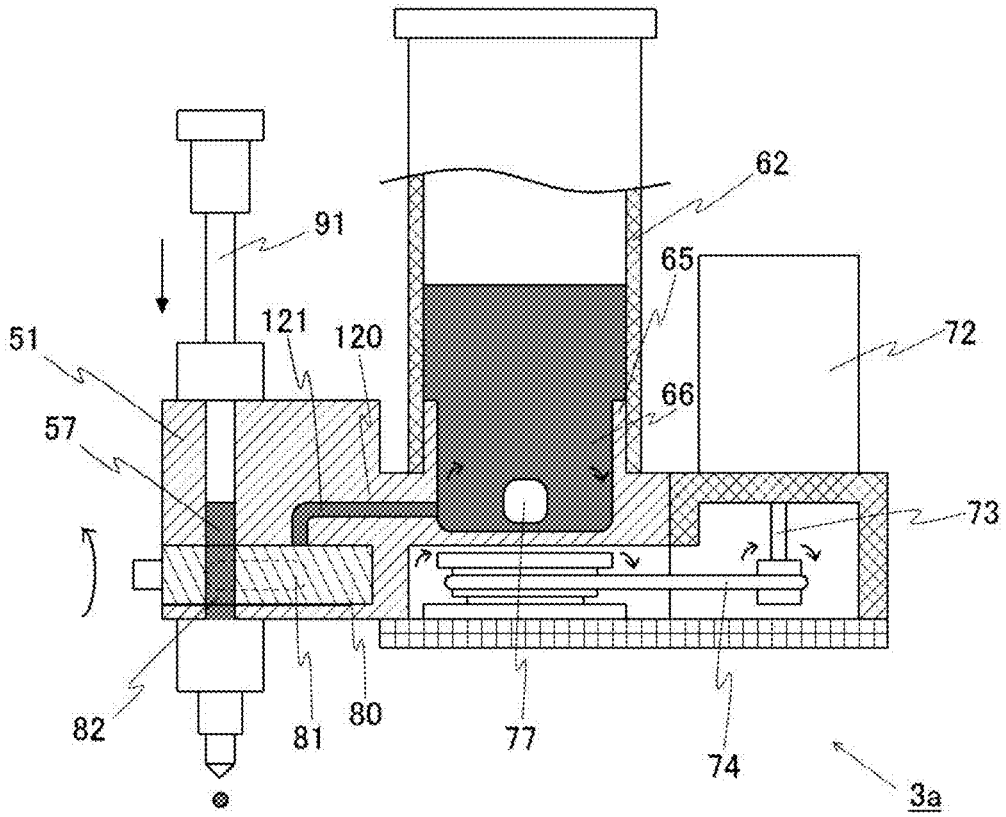

[Fig.11]
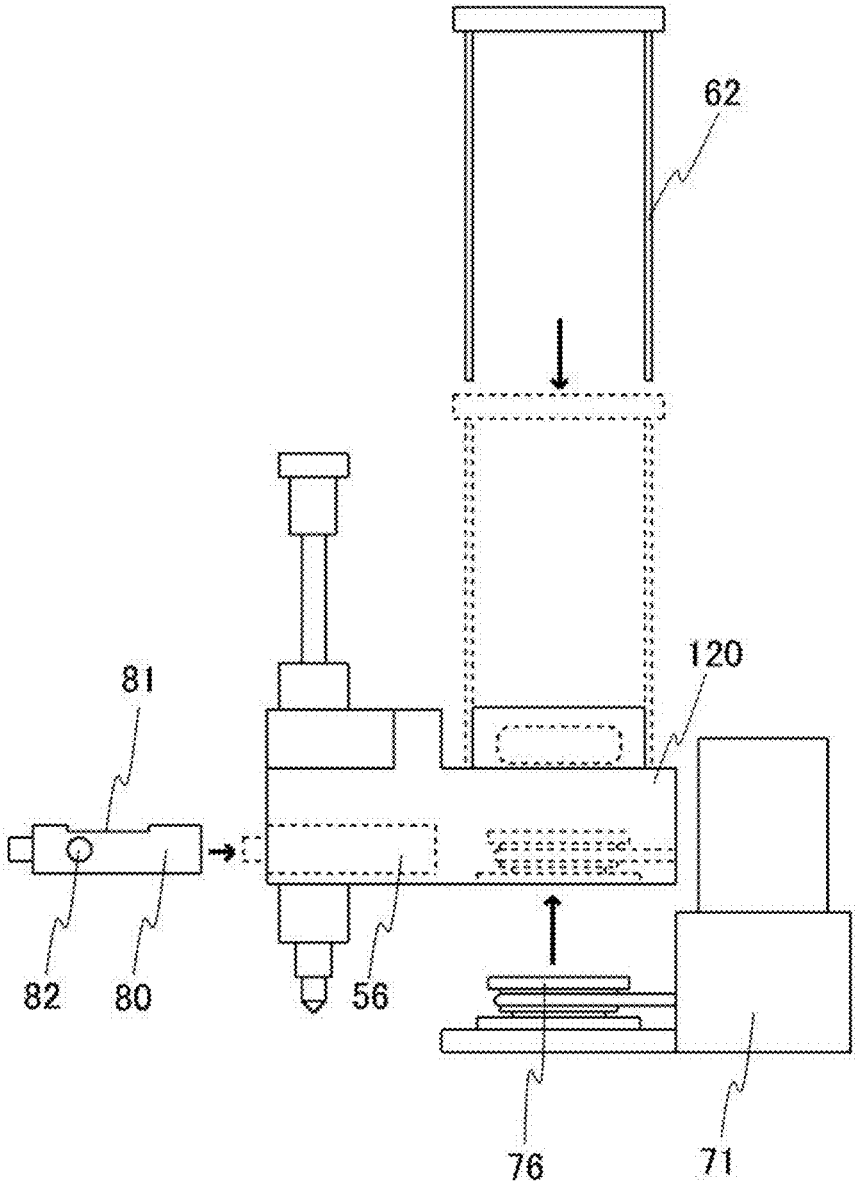

[Fig.12]
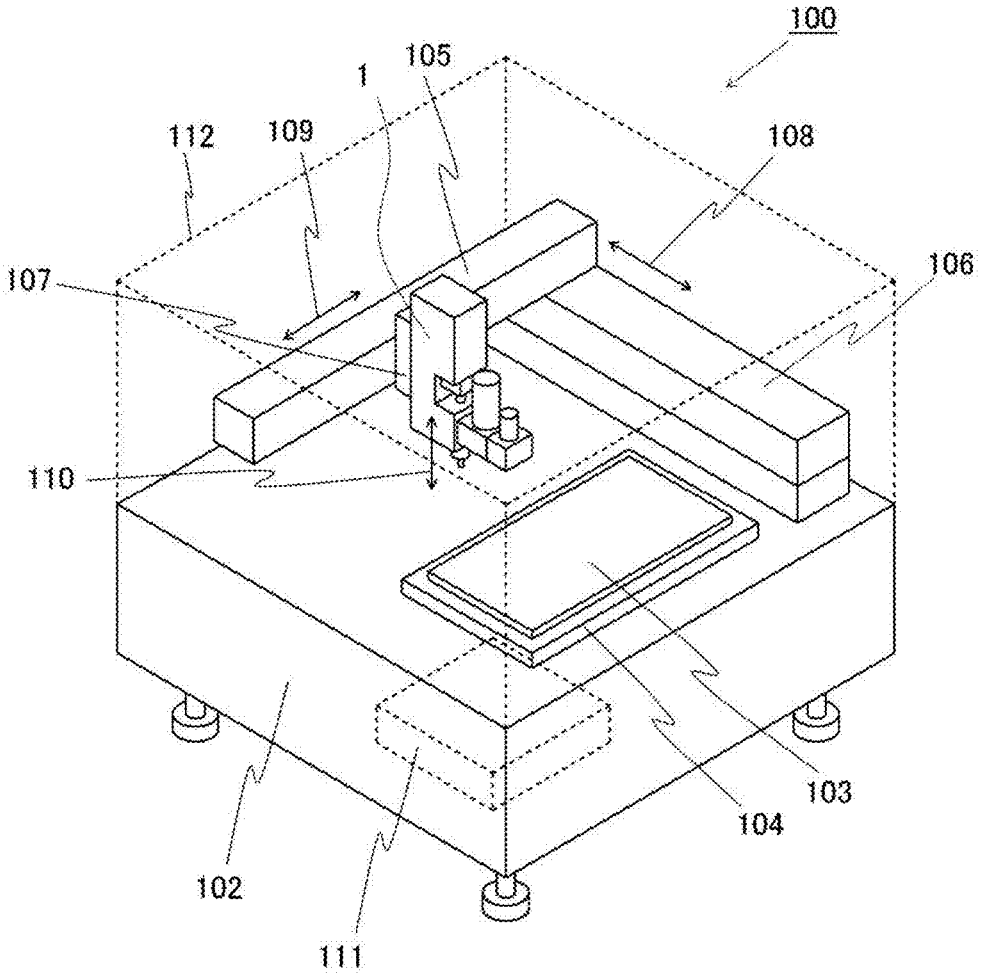

[Fig.13]
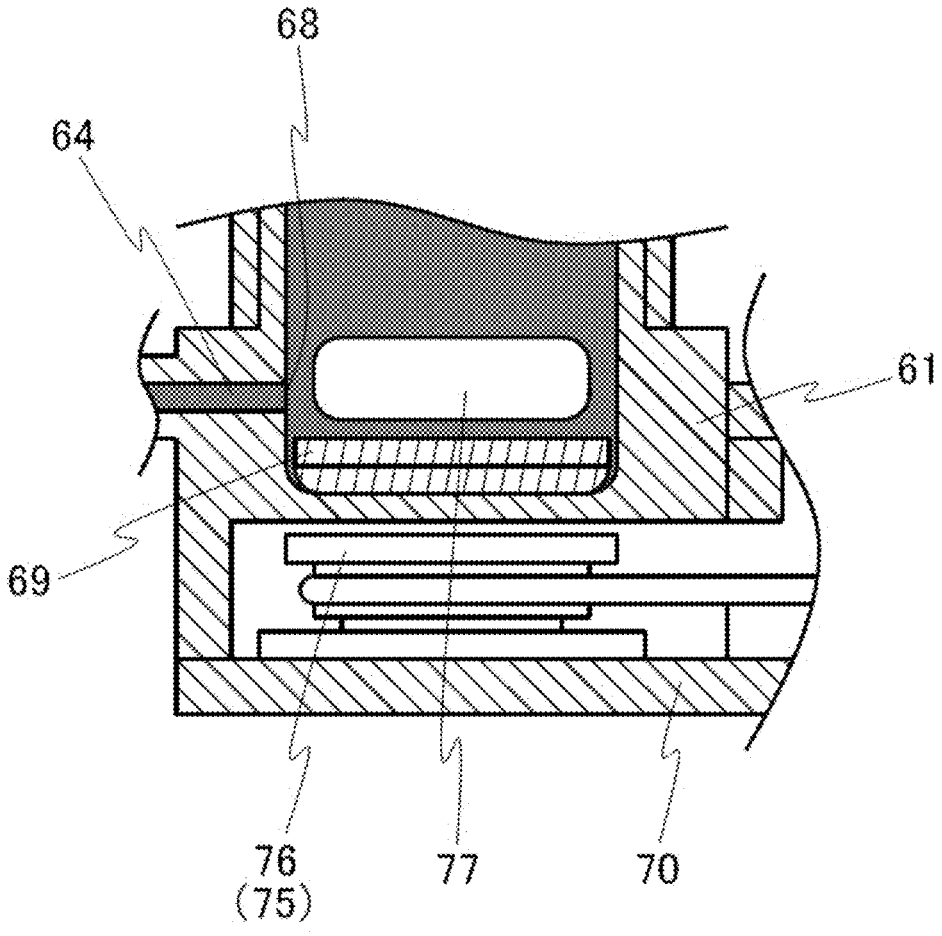

LIQUID DISCHARGE DEVICE, APPLICATION DEVICE WITH SAID DISCHARGE DEVICE, AND APPLICATION METHOD

TECHNICAL FIELD

The present invention relates to a liquid discharge device equipped with a stirring mechanism, an application device including the discharge device, and an application method using the application device.

BACKGROUND ART

Up to now, there has been known a liquid discharge device of plunger type discharging a liquid material from a discharge port by forward movement of a plunger sliding in close contact with an inner peripheral surface of a liquid chamber. In that type of liquid discharge device, the liquid material is discharged from a nozzle in an amount corresponding to a volume in the liquid chamber, the volume having been excluded by the movement of the plunger. The plunger-type discharge device is classified into two types, i.e., the type that the liquid material within the liquid chamber is used up, such as a syringe, and the type that the liquid material is supplied from the outside, such as a plunger pump.

The used-up type discharge device operates based on the discharge principle (see, e.g., FIGS. 3 and 4 in Patent Document 1) of pushing the liquid material out of the discharge port by moving the plunger disposed in a liquid-tight state toward the liquid material that is stored in the liquid chamber (metering chamber). After the plunger has been fully moved forward, an operation of filling the liquid material into the liquid chamber is needed.

On the other hand, in the plunger-pump type discharge device, the liquid material is stored in an external storage container, for example, and the liquid material is drawn by the plunger from the storage container. Then, the plunger is moved forward, thereby discharging the liquid material from the discharge port. That plunger-pump type discharge device includes a valve mechanism that is operated to cut off communication between the liquid chamber and the discharge port and to establish communication between the liquid chamber and the storage container when the liquid material is to be drawn into the liquid chamber from the storage container. When the liquid material is to be delivered from the liquid chamber to the discharge port, the valve mechanism is operated to cut off the communication between the liquid chamber and the storage container and to establish the communication between the liquid chamber and the discharge port (see, e.g., FIG. 1 in Patent Document 1).

Furthermore, when a liquid material containing particles, such as fillers, is to be discharged, a stirrer is disposed in the liquid chamber, and discharge work is performed in a state in which the fillers are dispersed in the liquid material. For example, Patent Document 1, in FIG. 4, proposes a device including a stirrer attached to a piston. However, the proposed device has the problem that, because a piston diameter increases, a liquid material L cannot be discharged in a small amount with high accuracy.

CITATION LIST

Patent Document

Patent Document 1: Japanese Patent Laid-Open Publication No. S61-217739

SUMMARY OF INVENTION

Technical Problem

The liquid discharge device (e.g., FIG. 1 in Patent Document 1) of the plunger pump type sucking and discharging the liquid material in the storage container, which is externally disposed and connected through a tube, has the following problem. Because the distance between a filling chamber and an extractor (nozzle) is long, the liquid material cannot be sufficiently stirred near the extractor, and the liquid material in a stirred state cannot be discharged from the nozzle.

In view of the above-described situation, an object of the present invention is to provide a liquid discharge device capable of discharging a liquid material stirred near a metering chamber, an application device including the discharge device, and an application method using the application device.

Solution to Problem

To solve the above-described problem, the present invention provides a liquid discharge device equipped with a stirring mechanism, the liquid discharge device comprising a storage unit including a storage container storing a liquid material, and a stirrer drive mechanism driving a stirrer disposed within the storage container; a discharge unit including a metering chamber to be filled with the liquid material, a plunger sliding in close contact with an inner peripheral surface of the metering chamber, a nozzle in communication with the metering chamber, and a switching valve switched between a first position at which the storage container and the metering chamber are communicated with each other, and a second position at which the metering chamber and the nozzle are communicated with each other; and a connection flow path through which the storage container and the metering chamber are communicated with each other, wherein the stirrer drive mechanism is separable from the storage unit.

The liquid discharge device may further comprise a discharge and storage block in which the connection flow path, the metering chamber, the switching valve, and a recessed portion constituting at least a bottom portion of the storage container are formed, and to which the nozzle is coupled.

The stirrer may be rotated by magnetic action, and the stirrer drive mechanism may include a magnetic body that is operated for rotation.

The connection flow path may have a communication port in communication with a lateral side of the recessed portion, and the magnetic body may be disposed under the recessed portion.

The stirrer drive mechanism may further comprise a stirrer drive device disposed adjacent to the storage container in a horizontal direction, and a transmission mechanism transmitting motive power of the stirrer drive device and operating the magnetic body for rotation.

The liquid discharge device may further comprise a bottom-raising member that is disposed at an inner bottom of the recessed portion to change a height of a bottom surface of the recessed portion.

The discharge and storage block may comprise a storage block including the recessed portion, and a discharge block including the metering chamber and the switching valve, the nozzle being coupled to the discharge block, and the storage block and the discharge block may be detachably coupled to each other.

The recessed portion may be disposed near a coupling portion coupling the discharge block and the storage block.

The connection flow path may be formed to pass through the coupling portion coupling the discharge block and the storage block.

The discharge and storage block may include a fitting portion, the storage unit may include a tubular member detachably fitted to the fitting portion, and the recessed portion and the tubular member may constitute the storage container.

A distance between the metering chamber and the recessed portion in the horizontal direction may be 10 cm or less.

A length of the connection flow path may be 10 cm or less.

The liquid discharge device may further comprise a discharge device drive unit including a plunger drive device that drives the plunger, wherein the discharge unit and the discharge device drive unit may be detachably coupled to each other.

The discharge unit in a state integral with the storage unit, which is in a state including the stirrer drive mechanism, may be detachably coupled to the discharge device drive unit, and the liquid material in the storage container can be stirred by operating the stirrer drive mechanism in a state in which the discharge unit is separated from the discharge device drive unit.

The discharge device drive unit may comprise a plunger holder coupled to the plunger, a plunger drive mechanism moving the plunger holder up and down, a slider supporting the plunger holder to be slidable in a vertical direction, and a switching valve drive device driving the switching valve, wherein the plunger holder, the plunger drive mechanism, and the slider may be arranged along one linear line extending in the vertical direction when viewed from the storage unit side.

The discharge device drive unit, the discharge unit, and the storage unit are arranged along one linear line extending in the horizontal direction.

An application device according to a first aspect of the present invention comprises the above-described liquid discharge device, a worktable on which a workpiece is placed, a drive device moving the liquid discharge device and the worktable relative to each other, and an operation control device controlling the drive device.

An application device according to a second aspect of the present invention comprises a plurality of the above-described liquid discharge devices, a worktable on which a workpiece is placed, a drive device moving the plurality of the liquid discharge devices and the worktable relative to each other, and an operation control device controlling the drive device.

The present invention further provides an application method of applying a liquid material by using the application device according to the first or second aspect.

In the application method, the liquid material may be a reagent or a biological sample.

Advantageous Effect of Invention

The present invention can provide the liquid discharge device capable of discharging the liquid material stirred near the metering chamber, the application device including the discharge device, and the application method using the application device.

BRIEF DESCRIPTION OF THE DRAWINGS

FIG. 1 is a perspective view of a liquid discharge device according to a first embodiment.

FIG. 2 is a side view of the liquid discharge device according to the first embodiment.

FIG. 3 is a perspective view of the liquid discharge device 1 in a state in which a discharge device drive unit and a discharge device main body are separated from each other.

FIG. 4 is a side sectional view of the discharge device main body according to the first embodiment, the view being referenced to explain the operation in a mode of sucking a liquid.

FIG. 5 is a side sectional view of the discharge device main body according to the first embodiment, the view being referenced to explain the operation in a mode of discharging the liquid material.

FIG. 6(*a*) is a front view of a discharge unit according to the first embodiment, and (b) is a rear view of the discharge unit according to the first embodiment.

FIG. 7 is a plan view referenced to explain the operation of a stirrer; specifically (a) illustrates the stirrer at a time n, and (b) illustrates the stirrer at a time m different from the time n.

FIG. 8 is an explanatory view referenced to explain a method of assembling the discharge device main body according to the first embodiment.

FIG. 9 is a side sectional view of a discharge device main body according to a second embodiment, the view being referenced to explain the operation in the mode of sucking the liquid material.

FIG. 10 is a side sectional view of the discharge device main body according to the second embodiment, the view being referenced to explain the operation in the mode of discharging the liquid material.

FIG. 11 is an explanatory view referenced to explain a method of assembling the discharge device main body according to the second embodiment.

FIG. 12 is a perspective view of an application device according to a third embodiment.

FIG. 13 is a side sectional view illustrating a storage unit according to another embodiment in an enlarged scale.

DESCRIPTION OF EMBODIMENTS

Embodiments for carrying out the present invention will be described below. In the following, the side where a stirring unit main body 71 illustrated in FIG. 1 is disposed is called the front side in some cases for the sake of explanation.

First Embodiment

FIG. 1 is a perspective view of a liquid discharge device 1 according to a first embodiment, and FIG. 2 is a side view of the liquid discharge device 1 according to the first embodiment. As illustrated in FIGS. 1 and 2, the liquid discharge device 1 mainly includes a discharge device drive unit 2 and a discharge device main body 3. As illustrated in FIG. 2, the discharge device drive unit 2, a discharge unit 5, a storage unit 6, and a stirrer drive mechanism 7 are integrally arranged so as to form a substantially L-shape when viewed from the side.

As illustrated in FIG. 2, the discharge device drive unit 2 includes a first motor (plunger drive device) 21, a plunger drive mechanism 22, a slider 23, and a plunger holder 24.

The plunger drive mechanism 22 is a conversion mechanism for converting rotary motion of the first motor 21 to linear motion in a vertical direction. The first motor 21 and the plunger drive mechanism 22 are constituted, for example, by a combination of a servomotor or a stepping motor and a ball screw, or by a linear motor.

The slider 23 is coupled to the plunger drive mechanism 22 and is vertically movable up and down in accordance with the linear motion of the plunger drive mechanism 22 in the vertical direction. Furthermore, the slider 23 is fixedly coupled to the plunger holder 24, and the plunger holder 24 is caused to slide in the vertical direction with the slider 23 vertically moving up and down. Thus, the discharge device drive unit 2 can vertically move the plunger holder 24 up and down through the plunger drive mechanism 22 and the slider 23 by operating the first motor 21.

As illustrated in FIGS. 1 and 3, the plunger holder 24 is formed in a substantially C-like shape opened downward when viewed from the front, and a plunger rear portion 93 having a disk-like shape can be held inside the plunger holder 24. With the plunger holder 24 vertically moving up and down, the plunger rear portion 93 held by the plunger holder 24 can also be vertically moved up and down together with the plunger holder 24.

In this embodiment, as illustrated in FIG. 2, the plunger holder 24, the plunger drive mechanism 22, and the slider 23 are arranged along one linear line extending in the vertical direction when viewed from the front (i.e., from the side where the storage unit 6 is disposed). Therefore, a width of the discharge device drive unit 2 when viewed from the front can be reduced in comparison with the case in which any of the plunger drive mechanism 22, the slider 23, and the plunger holder 24 is disposed at a position apart from the others in a horizontal direction.

The discharge device drive unit 2 further includes a second motor (switching valve drive device) 25. When the discharge device drive unit 2 and the discharge device main body 3 are coupled to each other as illustrated in FIG. 2, the second motor 25 is coupled to a switching valve 80 in the discharge device main body 3, and the switching valve 80 can be rotated in accordance with rotation of the second motor 25. Unlike this embodiment, the switching valve may be constituted by a slide valve in which a first position and a second position are switched over by parallel translation of a valve member.

In this embodiment, the discharge device drive unit 2 and the discharge device main body 3 are coupled in a detachable manner. FIG. 3 illustrates a state in which the discharge device drive unit 2 and the discharge device main body 3 are separated from each other. In order to enable the discharge device drive unit 2 and the discharge device main body 3 to be integrally coupled, the discharge device drive unit 2 includes a pair of discharge-unit support members 26 and a pair of screw holes 99, while the discharge device main body 3 includes a pair of wings 52 and a pair of through-holes 98.

The discharge-unit support members 26 are constituted by a pair of rectangular parallelepiped members projecting from a lateral surface of a drive unit main body 20, and each of upper surfaces of the pair of discharge-unit support members 26 are formed in substantially the same shape as bottom surfaces of the pair of wings 52. The bottom surfaces of the pair of wings 52 are supported by the pair of discharge-unit support members 26 in a state in which a discharge block 51 is inserted between the pair of discharge-unit support members 26.

The screw holes 99 of the discharge device drive unit 2 and the through-holes 98 of the discharge device main body 3 are formed at such positions that, when the discharge-unit support members 26 and the wings 52 are fitted to each other, screws can penetrate the through-holes 98 and can be screwed into the screw holes 99. The discharge device drive unit 2 and the discharge device main body 3 can be integrally coupled and fixed by inserting screws through the through-holes 98 from the side including the discharge device main body 3 toward the side including the discharge device drive unit 2, and by driving the screws into the screw holes 99.

The discharge unit 5 and the storage unit 6 both constituting the discharge device main body 3 are coupled in a detachable manner. More specifically, the discharge block 51 in the discharge unit 5 and a storage block 61 in the storage unit 6 are coupled in a detachable manner.

The discharge block 51 is a block-like member having a T-shape when viewed from the front or the rear, and it includes a pair of through-holes 97 (see FIG. 6). A pair of screw holes 96 (not illustrated) is formed in a lateral surface of the storage block 61, the lateral surface being positioned to face the pair of through-holes 97. The storage block 61 and the discharge block 51 can be integrally coupled and fixed by inserting screws through the through-holes 97 and by driving the screws into the screw holes 96 (see FIGS. 4 and 5). When necessary, the discharge device drive unit 2, the discharge unit 5, and the storage unit 6 can easily be separated from one another by removing the pairs of screws from the pairs of screw holes 96 and 99 and the pairs of screw holes 97 and 98.

As illustrated in FIG. 2, the discharge device main body 3 includes the discharge unit 5 for discharging the liquid material L, and the storage unit 6 for storing the liquid material L. The storage unit 6 includes the stirrer drive mechanism 7 for stirring the liquid material in the storage unit 6.

FIG. 4 is a side sectional view of the discharge device main body 3 according to the first embodiment, the view being referenced to explain the operation in a mode of sucking the liquid material. In FIG. 4, the stirrer drive mechanism 7 is denoted by a one-dot-chain line. FIG. 5 is a side sectional view of the discharge device main body 3 according to the first embodiment, the view being referenced to explain the operation in a mode of discharging the liquid material.

The liquid material L stored in the storage unit 6 is stirred inside the storage unit 6 by the action of the stirrer drive mechanism 7. The stirred liquid material L is sucked into the discharge unit 5 as illustrated in FIG. 4, and is then dripped to be discharged, as illustrated in FIG. 5, from a discharge port 59 of a nozzle 58 having a bombshell-like shape, the discharge port 59 being opened downward.

As illustrated in FIGS. 2 to 6, the discharge unit 5 includes the discharge block 51 and a plunger mechanism 90. Furthermore, as illustrated in FIGS. 3 to 6, the discharge block 51 includes the wings 52, an inlet port 53, a seal 54, a second flow path 55, a switching valve insertion hole 56, the switching valve (valve member) 80, a metering chamber 57, the nozzle 58, the discharge port 59, and the through-holes 97 and 98. FIG. 6(*a*) is a front view of the discharge unit 5 (when viewed from the side including the discharge device drive unit 2), and FIG. 6(*b*) is a rear view of the discharge unit 5 (when viewed from the side including the storage unit 6).

The switching valve insertion hole 56 extending in the horizontal direction is formed in a lateral surface of the discharge block 51 on the front side. The switching valve insertion hole 56 has substantially the same shape as the switching valve 80 having a columnar shape, and the switching valve 80 is inserted into the switching valve insertion hole 56. By coupling and fixing the discharge device drive unit 2 and the discharge device main body 3 to each other in the state of the switching valve 80 being inserted into the switching valve insertion hole 56, as illustrated in FIG. 2, the second motor 25 in the discharge device drive unit 2 is coupled to the switching valve 80 inserted into the switching valve insertion hole 56 such that the switching valve 80 can be rotated within the switching valve insertion hole 56 in accordance with the rotation of the second motor 25. On that occasion, the switching valve 80 having the columnar shape is rotated while moving in sliding contact with an inner peripheral surface and an innermost surface of the switching valve insertion hole 56 having the columnar shape.

A groove 81 extending in the horizontal direction is formed in a surface of the switching valve 80. In the state in which the switching valve 80 is inserted into the switching valve insertion hole 56, the groove 81 positioned between the switching valve 80 and the switching valve insertion hole 56 constitutes a third flow path extending in the horizontal direction. Furthermore, as illustrated in FIGS. 4 and 5, the discharge block 51 includes the second flow path 55 extending in the horizontal direction, and the metering chamber 57 extending in the vertical direction. When the third flow path is formed by rotating the switching valve 80 such that the groove 81 is positioned to locate in an upper portion of the switching valve 80, one end portion of the third flow path is communicated with the second flow path 55, and the other end portion of the third flow path is communicated with the metering chamber 57 in the discharge block 51.

The second flow path 55 is communicated with a first flow path 64 in the storage unit 6, and the first flow path 64 and the second flow path 55 constitute a connection path. Accordingly, the liquid material L stored in the storage unit 6 can be sucked into the metering chamber 57 in the discharge unit 5 through the first flow path 64, the second flow path 55, and the third flow path. In the following description, a position (orientation) of the switching valve 80 at which the metering chamber 57 and the storage unit 6 are communicated with each other is called a first position.

The switching valve 80 has a through-hole 82 penetrating the switching valve 80 in the vertical direction. By operating the second motor 25 and rotating the switching valve 80, one end portion of the through-hole 82 is communicated with the metering chamber 57 positioned on the upper side, and the other end portion of the through-hole 82 is communicated with the nozzle 58 positioned on the lower side. Thus, by rotating the switching valve 80 to the position at which the metering chamber 57 and the nozzle 58 are communicated with each other, the liquid material L sucked into the metering chamber 57 can be dripped and discharged from the discharge port 59 of the nozzle 58 via the through-hole 82. In the following description, the position (orientation) of the switching valve 80 at which the metering chamber 57 and the nozzle 58 are communicated with each other is called a second position.

As described above, when the switching valve 80 is brought into the first position, a flow path of the liquid material L from the storage unit 6 to the metering chamber 57 is opened, and a flow path of the liquid material L from the metering chamber 57 to the nozzle 58 is cut off. When the switching valve 80 is brought into the second position, the flow path of the liquid material L from the storage unit 6 to the metering chamber 57 is cut off, and the flow path of the liquid material L from the metering chamber 57 to the nozzle 58 is opened. Thus, in cooperation with a peripheral surface defining the switching valve insertion hole 56, the switching valve 80 in this embodiment constitutes a switching valve that controls opening and closing of the flow path of the liquid material L from the storage unit 6 to the metering chamber 57 and the flow path of the liquid material L from the storage unit 6 to the metering chamber 57.

The plunger mechanism 90 includes a plunger rod 91, a plunger tip portion 92, and a plunger tail-end portion 93. The plunger rod 91, the plunger tip portion 92, and the plunger tail-end portion 93 are integrally coupled together, and the plunger mechanism 90 is vertically moved up and down in accordance with vertical movement of the plunger holder 24 that holds the plunger tail-end portion 93.

The plunger tip portion 92 is a columnar member that is constituted to be slidable in close contact with an inner peripheral surface of the metering chamber 57 having the columnar shape. When the switching valve 80 is at the first position as illustrated in FIG. 4, the liquid material L can be sucked into the metering chamber 57 from the storage unit 6 by sliding the plunger tip portion 92 upward. When the switching valve 80 is at the second position as illustrated in FIG. 5, the liquid material L filled in the metering chamber 57 can be discharged from the nozzle 58 by sliding the plunger tip portion 92 downward. The liquid material L filled in the metering chamber 57 may be discharged plural times in units of a certain amount by operating the plunger mechanism 90 to move downward plural times step by step, or may be all discharged at a time by operating the plunger mechanism 90 to move downward once.

The storage unit 6 includes the storage block 61 including a fitting portion 65 and a recessed portion 66, and a tubular member 62 attached to the fitting portion 65.

The storage block 61 is detachably fixed onto a later-described base plate 70 by using fixtures such as screws. An outer periphery of the fitting portion 65 having a tubular shape and extending upward from an upper surface of the storage block 61 is formed to have substantially the same diameter as an inner periphery of the tubular member 62. By fitting the fitting portion 65 to the tubular member 62 through a lower opening thereof, the storage block 61 and the tubular member 62 are detachably fixed to each other. When the fitting portion 65 and the tubular member 62 are fitted to each other as illustrated in FIG. 4 or 5, the recessed portion 66 and the tubular member 62 constitute a storage container, and the liquid material L in an amount necessary for performing the discharge many times can be stored in the storage container. In other words, the storage container has a volume at least several times or more that of the metering chamber 57. The storage container is disposed near a coupling portion (i.e., a projected portion 67) between the discharge block 51 and the storage block 61 such that a length of the first flow path 64 can be reduced.

As illustrated in FIGS. 4 and 5, the stirrer drive mechanism 7 includes the base plate 70, the stirring unit main body 71, a third motor (stirrer drive device) 72, a shaft 73, a belt 74, a rotating member 75, and a magnetic body 76. A stirring mechanism is constituted by the stirrer drive mechanism 7 and the stirrer 77. For example, a magnet stirrer rotatable by the magnetic action of the magnetic body 76 having a disk-like shape can be used as the stirrer 77.

The third motor 72 transmits rotational motion of the shaft 73 to the rotating member 75 through the belt 74 and rotates the rotating member 75. The magnetic body 76 having a large diameter is disposed above the rotating member 75, and the magnetic body 76 is also rotated in accordance with the rotational motion of the rotating member 75. In this embodiment, the magnetic body 76 is constituted by a magnet. The stirrer 77 placed in the storage container is rotated, as illustrated in FIG. 7, by receiving the magnetic action of the rotating magnetic body 76. As a result, the liquid material L stored in the storage container is stirred. FIG. 7 is a plan view referenced to explain the operation of the stirrer 77, and it illustrates how the stirrer 77 rotates on a bottom surface of the storage container. More specifically FIG. 7(*a*) illustrates the stirrer 77 at a time n, and FIG. 7(*b*) illustrates the stirrer 77 at a time m different from the time n. In FIG. 7(*b*), the stirrer 77 is rotated from the state illustrated in FIG. 7(*a*) by 90° in accordance with the rotational motion of the stirrer 77.

A cylindrical projected portion 67 including an opening of the first flow path 64 is formed on the lateral surface of storage block 61, and the opening of the first flow path 64 is formed at a center of the projected portion 67. The projected portion 67 is formed in the same shape as a recessed portion that is formed in the lateral surface of discharge block 51 and that includes the inlet port 53. By fitting the projected portion of the storage block 61 to the recessed portion of the discharge block 51, the first flow path 64 and the inlet port 53 can be directly connected to each other, and an overall length of the first flow path 64 and the second flow path 55 (connection path) can be shortened. Accordingly, the storage container (62, 66) can be disposed near the metering chamber 57. In this embodiment, the distance between the metering chamber 57 and the storage container (62, 66) in the horizontal direction is, for example, 10 cm or less (preferably 7 cm or less). The nozzle 58 is detachably fixed to a bottom surface of the discharge block 51 such that the distance between the discharge port 59 and the storage container (62, 66) is shortened.

As illustrated in FIG. 6(*b*), the seal 54 (not illustrated in FIGS. 4 and 5) is disposed in a joint portion between the first flow path 64 and the inlet port 53. The discharge unit 5 and the storage unit 6 can be detachably coupled and fixed to each other by fixtures, such as screws, through the through-holes 97 of the discharge unit 5.

In this embodiment, as described above, since the discharge unit 5 and the storage unit 6 are integrally connected to each other, the liquid material L stirred in the storage unit 6 can be directly sucked from the storage unit 6 into the discharge unit 5. Furthermore, since the flow path for connection between the discharge unit 5 and the storage unit 6 can be constituted in a short length, the flow path through which the liquid material L stirred in the storage unit 6 is supplied to the discharge unit 5 can be shortened (namely, the liquid material can be stirred near the discharge unit 5), and the liquid material L can be supplied to the discharge unit 5 while it is kept in a dispersed state. When the liquid material L contains fillers, this embodiment is further effective in suppressing precipitation of the fillers.

Moreover, since the recessed portion 66 of the storage container and the switching valve 80 (switching valve insertion hole 56) are formed in individual blocks, i.e., the discharge block and the storage block, the connection flow path (i.e., the first flow path 64 and the second flow path 55) can also be entirely formed in the blocks. Accordingly, a length of the connection flow path can be shortened and a shape of the connection flow path can be more reliably maintained constant in comparison with the case of forming the connection flow path by an elastic tube, for example. Since indefinite factors are eliminated as described above, the liquid material can be stably transferred while it is maintained in the dispersed state. In addition, since the recessed portion 66 is formed in the block, the magnetic body 76 of the stirrer drive mechanism 7 can be arranged near the lower side of the storage container, and a port 68 in communication with the connection flow path can be positioned in the lateral surface of the storage container. As a result, the liquid material in the storage container can be stirred with high efficiency, and the liquid material in the properly dispersed state can be transferred to the second flow path 55 through the communication port 68, which is positioned away from the bottom surface of the storage container, even when the liquid material or the fillers having higher specific gravity partially stagnate on the bottom surface of the storage container.

In the above case, as illustrated in FIG. 13, a height of the real bottom surface of the storage container may be changed by placing a required number of bottom raising members, which are formed of, for example, plates each having an appropriate shape, at an inner bottom of the recessed portion 66. As a result, the height of the communication port relative to the actual bottom surface can be changed. Because the dispersed state of the liquid material tends to depend on the height from the bottom surface, it is possible not only to obtain the above-described merit of the connection flow path, but also to transfer the liquid material in the desired dispersed state to the connection flow path.

How to disassemble and assemble the liquid discharge device 1 when exchanging the liquid material or carrying out maintenance or cleaning will be described below. As described above, the discharge device drive unit 2 and the discharge device main body 3 are coupled and fixed to each other by inserting fixtures, such as screws, through the through-holes 97 and 98 and into the screw holes 96 and 99. Hence they can be separated by removing those fixtures. Furthermore, the individual components of the discharge device main body 3 are also assembled in a detachable manner. For example, the discharge unit 5 and the storage unit 6 are coupled and fixed to each other by fixtures, such as screws, through the through-holes 97. Hence both the units can be separated by removing those fixtures. In the discharge unit 5, the switching valve 80 and the plunger mechanism 90 can be removed from the discharge block 51. In the storage unit 6, the storage block 61 and the stirrer drive mechanism 7 can be separated from each other, a cap 63 can be removed from the tubular member 62, and the tubular member 62 can be removed from the storage block 61. It is therefore possible to individually perform cleaning, replacement, etc. of various members included in the discharge device main body 3 and coming into contact with the liquid material L, i.e., the discharge block 51 (including the metering chamber 57, the switching valve insertion hole 56, and the second flow path 55), the switching valve 80, the plunger mechanism 90 (including the plunger tip portion 92), the storage block 61 (including the first flow path 64 and the recessed portion 66), the tubular member 62, and the cap 63.

After exchange of the liquid material, maintenance, or cleaning, the discharge device main body 3 can be assembled as follows. The discharge unit 5 is assembled by attaching the plunger mechanism 90 to discharge block 51, and by, as illustrated in FIG. 8, inserting the switching valve 80 into the switching valve insertion hole 56, thereby attaching the switching valve 80 to the discharge block 51. The storage unit 6 is assembled by attaching the tubular member 62 to the storage block 61, and by attaching the cap 63 to the tubular member 62. Furthermore, as illustrated in FIG. 8, the storage block 61 is attached to the base plate 70, thus coupling the storage block 61 and the stirrer drive mechanism 7 to each other. After fitting the projected portion 67 of the storage block 61 to the recessed portion of the discharge block 51, the storage unit 6 and the discharge unit 5 are coupled to each other by screws, for example, through the through-holes 97. Then, the discharge device drive unit 2 and the discharge device main body 3 are coupled and fixed to each other by inserting fixtures, such as screws, through the through-holes 98 and into the screw holes 99. The discharge device main body 3 can be assembled in such a manner.

In the liquid discharge device 1 according to this embodiment, as described above, since the discharge unit 5 and the storage unit 6 are disposed in a connected state, the liquid material stirred near the discharge unit 5 can be appropriately supplied to the discharge unit 5. In the related art in which the discharge unit and the storage container are separated from each other with a tube or the like interposed between them, there has been a problem that precipitation occurs until the liquid material L stirred in the storage container reaches the discharge unit 5. However, this embodiment can solve the above problem.

In particular, when the liquid material L is a reagent or a biological sample such as a protein or an enzyme, a component (solute) tends to be hard to disperse. According to this embodiment, however, since the liquid material can be stirred near the discharge unit 5, the liquid material L can be discharged while a dispersive component in the liquid material L is kept in a dispersed state.

Furthermore, when the liquid material L is a reagent or a biological sample, it is often expensive even in small amounts. With the liquid discharge device 1 according to this embodiment, since the storage container (62, 66) can be disposed near the metering chamber 57, an amount of the liquid material wasted in a step of exchanging the liquid material can be minimized in the operation of discharging an expensive liquid material.

Moreover, according to this embodiment, since the discharge device drive unit 2 and the discharge device main body 3 are detachably coupled to each other, it is possible to take out only the discharge device main body 3 that comes into contact with the liquid material L, and to clean the discharge device main body 3. Therefore, cleaning work and maintenance work can easily be performed, for example, when the liquid material is exchanged. Stated in another way, the discharge device drive unit 2 includes members having comparatively large weights, such as the first motor 21, the plunger drive mechanism 22, and the second motor 25, while the discharge device main body 3 is constituted by members having comparatively small weights. According to this embodiment, since only the discharge device main body 3 having comparatively small weight can be taken out to perform cleaning, for example, the cleaning work and the maintenance work are facilitated.

In this embodiment, since the stirrer drive mechanism 7 can easily be separated from the storage unit 6, the members constituting the storage unit 6 and coming into contact with the liquid material L can easily be cleaned. Thus, efficiency of work for cleaning the storage unit 6 can be increased. It is further possible to clean the stirrer drive mechanism 7 without making electric parts of the stirrer drive mechanism 7 contacted with water.

Additionally, in this embodiment, the discharge device drive unit 2, the discharge unit 5, the storage unit 6, and the stirrer drive mechanism 7 are arranged along one linear line extending in the horizontal direction as illustrated in FIG. 1 or 2. With that arrangement, a width of the liquid discharge device 1 when viewed from the front can be reduced, and in the case of installing a plurality of the liquid discharge devices 1 side by side, a wider movable range can be obtained for each device.

Second Embodiment

A liquid discharge device 1*a* according to a second embodiment will be described below. The liquid discharge device 1*a* according to the second embodiment has the same structure as the liquid discharge device 1 according to the first embodiment except for points described below, and it operates in a similar way to the liquid discharge device 1.

As illustrated in FIGS. 9 and 10, the liquid discharge device 1*a* includes a discharge device main body 3*a* instead of the discharge device main body 3 in the first embodiment. The discharge device main body 3*a* includes, instead of the discharge block 51 and the storage block 61 in the first embodiment, a discharge and storage block 120 in which portions corresponding to the discharge block and the storage block are integrated into a seamless one-piece block. FIGS. 9 and 10 are each a side sectional view of the discharge device main body 3*a* according to the second embodiment.

As in the storage block 61 according to the first embodiment, the discharge and storage block 120 includes the fitting portion 65 to which the tubular member 62 is fitted, and the recessed portion 66 constituting a bottom portion of the storage container. Furthermore, as in the storage block 61 according to the first embodiment, the discharge and storage block 120 and the base plate 70 are detachably coupled to each other by using fixtures such as screws. An outer periphery of the fitting portion 65 having a tubular shape and extending upward from an upper surface of the discharge and storage block 120 is formed to have substantially the same diameter as an inner periphery of the tubular member 62. By fitting the fitting portion 65 to the tubular member 62 through a lower opening thereof, the tubular member 62 can be fixed in a detachable manner. When the fitting portion 65 and the tubular member 62 are fitted to each other, the recessed portion 66 and the tubular member 62 constitute the storage container (62, 66), and the liquid material L in an amount necessary for performing the discharge many times can be stored in the storage container. In addition, the stirrer 77 can be placed on the bottom surface of the recessed portion 66, and the liquid material L in the storage container (62, 66) can be stirred by the action of the stirrer drive mechanism 7.

In the discharge and storage block 120, since the portions corresponding to the discharge block and the storage block are integrated into the seamless one-piece block, the connection flow path (i.e., the first flow path 64 and the second flow path 55) from the storage container (62, 66) to the switching valve insertion hole 56 is not in the separable form unlike the first embodiment, and a connection flow path 121 is formed as an integral path. The storage container (62, 66) is disposed near the metering chamber 57 with the connection flow path 121 interposed between them. The distance between the metering chamber 57 and the storage container (62, 66) in the horizontal direction is, for example, 10 cm or less (preferably 7 cm or less).

The plunger tip portion 92 in the second embodiment has substantially the same diameter as each of the metering chamber 57 and the plunger rod 91, but it may be constituted in the same structure as in the first embodiment.

Also in the second embodiment, as in the first embodiment, when the switching valve 80 is brought into the first position, the flow path of the liquid material L from the storage container (62, 66) to the metering chamber 57 is opened, and the flow path of the liquid material L from the metering chamber 57 to the nozzle 58 is cut off as illustrated in FIG. 9. On the other hand, when the switching valve 80 is brought into the second position, the flow path of the liquid material L from the storage container (62, 66) to the metering chamber 57 is cut off, and the flow path of the liquid material L from the metering chamber 57 to the nozzle 58 is opened as illustrated in FIG. 10. Thus, in cooperation with the peripheral surface defining the switching valve insertion hole 56, the switching valve 80 in the second embodiment also constitutes a switching valve that controls opening and closing of the flow path of the liquid material L from the storage container (62, 66) to the metering chamber 57 and the flow path of the liquid material L from the storage container (62, 66) to the metering chamber 57.

Work for disassembling and assembling the liquid discharge device 1*a* according to the second embodiment will be described below. In the second embodiment, the discharge device drive unit 2 and the discharge device main body 3*a* are coupled and fixed to each other by using fixtures such as screws. Hence they can be separated by removing those fixtures. Also in the discharge device main body 3*a*, the discharge and storage block 120 and the stirrer drive mechanism 7 can be separated from each other, and the tubular member 62 can be removed from the fitting portion 65 of the discharge and storage block 120. It is therefore possible to individually perform cleaning, replacement, etc. of various members included in the discharge device main body 3*a* and coming into contact with the liquid material L, i.e., the switching valve 80, the plunger mechanism 90 (including the plunger tip portion 92), the discharge and storage block 120 (including the metering chamber 57, the switching valve insertion hole 56, the connection flow path 121, and the recessed portion 66), the tubular member 62, and the cap 63.

On the other hand, when assembling the liquid discharge device 1*a*, as illustrated in FIG. 11, the switching valve 80 is inserted into the switching valve insertion hole 56, and the plunger mechanism 90 and the tubular member 62 are attached to the discharge and storage block 120. Furthermore, as illustrated in FIG. 11, the discharge and storage block 120 is attached to the base plate 70, whereby the discharge and storage block 120 and the stirrer drive mechanism 7 are coupled to each other. Then, the discharge device drive unit 2 and the discharge device main body 3*a* are coupled and fixed to each other by inserting fixtures, such as screws, through the through-holes 98 and into the screw holes 99. The discharge device main body 3*a* can be assembled in such a manner.

As described above, the liquid discharge device 1*a* according to the second embodiment includes the discharge device main body 3*a* in which the discharge unit and the storage unit are integrated into the seamless one-piece unit. With the discharge device main body 3*a*, since the storage container (62, 66) is disposed near the metering chamber 57 as in the first embodiment, it is possible to shorten the connection flow path 121 through which the liquid material L stirred in the storage container (62, 66) passes when supplied to the metering chamber 57 (i.e., to stir the liquid material near the metering chamber 57), and to effectively suppress precipitation of the liquid material L on the way to the metering chamber 57.

Furthermore, with the discharge device main body 3*a* according to this embodiment, since the discharge unit and the storage unit are integrated into the seamless one-piece unit, the number of steps needed in the work for disassembling and assembling the liquid discharge device 1*a* is reduced in comparison with that in the first embodiment when the liquid material is replaced, or when maintenance or cleaning is performed. Hence the work for disassembling and assembling the liquid discharge device 1*a* is facilitated.

Third Embodiment

A third embodiment of the present invention will be described below. FIG. 12 is a perspective view of an application device 100 according to the third embodiment. The application device 100 includes, on a bench 102, a table 104 on which a workpiece 103, i.e., an application target, is placed, an X drive device 105, a Y drive device 106, and a Z drive device 107, those drive devices moving the liquid discharge device 1 relative to the workpiece 103. The XYZ drive devices (105, 106, 107) are movable in directions denoted by reference signs 108, 109 and 110, respectively. A control device 111 for controlling the operation of the liquid discharge device 1 and the operations of the drive devices (105, 106, 107) is installed within the bench 102. A space above the bench 102 is surrounded by a cover 112 denoted by dotted lines, and the space inside of the cover 112 can be brought into a negative pressure environment by using, for example, a vacuum pump not illustrated. The cover 112 may include a door for access to the inside of the space. Although the space inside of the caver 112 is under an atmospheric pressure environment in this embodiment, application work may be performed under the negative pressure environment.

As described above, the application device 100 according to this embodiment includes the liquid discharge device 1 according to the above embodiment. In the liquid discharge device 1 according to the above embodiment, the discharge device drive unit 2 and the discharge device main body 3 are detachably coupled to each other. Therefore, when the liquid discharge device 1 is mounted to a head unit of the application device 100 illustrated in FIG. 12, only the discharge device main body 3 can be separated from the application device 100 while the discharge device drive unit 2 is kept fixed on the head unit of the application device 100, and efficiency in the work for performing maintenance, such as cleaning, can be improved.

Furthermore, the discharge device main body 3 may be constituted such that, as illustrated in FIG. 3, the discharge unit 5 is detachable from the discharge device drive unit 2 together with the storage unit 6 in the state including the stirrer drive mechanism 7, and that the liquid material in the storage container can be stirred by operating the stirrer drive mechanism 7 in the discharge device main body 3 which is in the state separated from the discharge device drive unit 2. In such a case, the liquid material can be continuously maintained in the properly stirred state even in a standby mode during pause of application work.

Although the preferred embodiments of the present invention have been described above, the technical scope of the present invention is not limited to the matters described in the above embodiments. The above embodiments can be variously modified and improved, and those modified and improved embodiments also fall within the technical scope of the present invention.

While, in the above embodiments, the discharge device drive unit 2, the discharge unit 5, the storage unit 6, and the stirrer drive mechanism 7 are arranged, by way of example, along one linear line extending in the horizontal direction (Y-axis direction), the present invention is not limited to such an arrangement. In another example, the stirrer drive mechanism 7 may be disposed above or under the storage unit 6.

While the above embodiments have been described, by way of example, in connection with the application device 100 including one liquid discharge device 1, the present invention is not limited that type of application device, and the application device may include a plurality of the liquid discharge devices 1. In a structure in which the plurality of the liquid discharge devices 1 are disposed on the X drive device 105, the liquid discharge devices 1 each having a narrower width is advantageous from the viewpoint of an operation pitch, etc. A method of discharging the liquid material in the liquid discharge device 1 is not limited to dripping, and the liquid material may be discharged in such a manner that, after the liquid material flowing out of the discharge port 59 has landed on the workpiece, the liquid material is detached from the discharge port 59.

LIST OF REFERENCE SIGNS

1: liquid discharge device
2: discharge device drive unit
20: drive unit main body
21: first motor (plunger drive device)
22: plunger drive mechanism
23: slider
24: plunger holder
25: second motor (switching valve drive device)
26: discharge unit support member
99: screw hole
3: discharge device main body
5: discharge unit
51: discharge block
52: wing
53: inlet port
54: seal
55: second flow path
56: switching valve insertion hole
57: metering chamber
58: nozzle
59: discharge port
97: through-hole
98: through-hole
6: storage unit
61: storage block
62: tubular member
63: cap
64: first flow path
65: fitting portion
66: recessed portion
67: projected portion
68: communication port
69: bottom-raising member
7: stirrer drive mechanism
70: base plate
71: stirring unit main body
72: third motor
73: shaft
74: belt
75: rotating member
76: magnetic body
77: stirrer
80: switching valve
81: groove
82: through-hole
90: plunger mechanism
91: plunger rod
92: plunger tip portion
93: plunger tail-end portion
100: application device
102: bench
103: workpiece
104: table
105: X drive device
106: Y drive device
107: Z drive device
111: control device
112: cover
120: discharge and storage block
121: connection flow path
L: liquid material

The invention claimed is:

1. A liquid discharge device equipped with a stirring mechanism, the liquid discharge device comprising:
- a storage unit including:
  - a storage container storing a liquid material; and
  - a stirrer drive mechanism for a magnet stirrer, the stirrer drive mechanism including a magnetic body that drives the stirrer disposed within the storage container by magnetic action, and being integrally constituted with the storage container;
- a discharge unit including:
  - a metering chamber to be filled with the liquid material;
  - a plunger sliding in close contact with an inner peripheral surface of the metering chamber;
  - a nozzle in communication with the metering chamber; and
  - a switching valve switched between a first position at which the storage container and the metering chamber are communicated with each other, and a second position at which the metering chamber and the nozzle are communicated with each other; and
- a connection flow path through which the storage container and the metering chamber are communicated with each other,
- wherein the discharge unit and the storage unit are integrally constituted with each other,
- wherein the liquid discharge device further comprises a discharge device drive unit including a plunger drive device that drives the plunger,
- wherein the discharge unit is detachably coupled to the discharge device drive unit, and
- wherein the discharge device drive unit, the discharge unit, and the storage unit are arranged along one linear line extending in the horizontal direction.

2. The liquid discharge device according to claim 1, wherein the discharge device drive unit includes the plunger drive device and a switching valve drive device, which drives the switching valve, in an integral form.

3. The liquid discharge device according to claim 1, wherein the discharge unit in a state integral with the storage unit, which is in a state including the stirrer drive mechanism, is detachably coupled to the discharge device drive unit, and
- the liquid material in the storage container can be stirred by operating the stirrer drive mechanism in a state in which the discharge unit is separated from the discharge device drive unit.

4. The liquid discharge device according to claim 1, wherein the discharge device drive unit comprises:

a plunger holder coupled to the plunger;

a plunger drive mechanism moving the plunger holder up and down;

a slider supporting the plunger holder to be slidable in a vertical direction; and a switching valve drive device driving the switching valve, wherein the plunger holder, the plunger drive mechanism, and the slider are arranged along one linear line extending in the vertical direction when viewed from the storage unit side.

5. The liquid discharge device according to claim 1, wherein the stirrer drive mechanism is separable from the storage unit.

6. The liquid discharge device according claim 1, wherein the connection flow path is connected to a hole disposed at a lateral side wall of the storage container.

7. The liquid discharge device according to claim 1, wherein a length of the connection flow path is 10 cm or less.

8. An application device comprising the liquid discharge device according to claim 1;

a worktable on which a workpiece is placed;

a drive device moving the liquid discharge device and the worktable relative to each other; and an operation control device controlling the drive device.

9. An application device comprising a plurality of the liquid discharge devices according to claim 1;

a worktable on which a workpiece is placed;

a drive device moving the plurality of the liquid discharge devices and the worktable relative to each other; and an operation control device controlling the drive device.

10. An application method of applying a liquid material by using the application device according to claim 8.

11. The application method according to claim 10, wherein the liquid material is a reagent or a biological sample.

12. A liquid discharge device equipped with a stirring mechanism, the liquid discharge device comprising:

a storage unit including:

a storage container storing a liquid material; and a stirrer drive mechanism for a magnet stirrer, the stirrer drive mechanism including a magnetic body that drives the stirrer disposed within the storage container by magnetic action, and being integrally constituted with the storage container;

a discharge unit including:

a metering chamber to be filled with the liquid material;

a plunger sliding in close contact with an inner peripheral surface of the metering chamber;

a nozzle in communication with the metering chamber; and a switching valve switched between a first position at which the storage container and the metering chamber are communicated with each other, and a second position at which the metering chamber and the nozzle are communicated with each other; and a connection flow path through which the storage container and the metering chamber are communicated with each other, wherein the discharge unit and the storage unit are integrally constituted with each other, wherein the magnetic body is disposed under the storage container, and the stirrer drive mechanism comprises:

a stirrer drive device disposed adjacent to the storage container in a horizontal direction; and a transmission mechanism transmitting motive power of the stirrer drive device and operating the magnetic body for rotation.

13. A liquid discharge device equipped with a stirring mechanism, the liquid discharge device comprising:

a storage unit including:

a storage container storing a liquid material; and a stirrer drive mechanism for a magnet stirrer, the stirrer drive mechanism including a magnetic body that drives the stirrer disposed within the storage container by magnetic action, and being integrally constituted with the storage container;

a discharge unit including:

a metering chamber to be filled with the liquid material;

a plunger sliding in close contact with an inner peripheral surface of the metering chamber;

a nozzle in communication with the metering chamber; and a switching valve switched between a first position at which the storage container and the metering chamber are communicated with each other, and a second position at which the metering chamber and the nozzle are communicated with each other; and a connection flow path through which the storage container and the metering chamber are communicated with each other, wherein the discharge unit and the storage unit are integrally constituted with each other, wherein the liquid discharge device further comprises a discharge and storage block in which the connection flow path, the metering chamber, the switching valve, and a recessed portion constituting at least a bottom portion of the storage container are formed, and to which the nozzle is coupled.

14. The liquid discharge device according to claim 13, wherein the connection flow path has a communication port in communication with a lateral side of the recessed portion, and the magnetic body is disposed under the recessed portion.

15. The liquid discharge device according to claim 14, wherein the stirrer drive mechanism comprises:

a stirrer drive device disposed adjacent to the storage container in a horizontal direction; and a transmission mechanism transmitting motive power of the stirrer drive device and operating the magnetic body for rotation.

16. The liquid discharge device according to claim 13, further comprising a bottom-raising member that is disposed at an inner bottom of the recessed portion to change a height of a bottom surface of the recessed portion.

17. The liquid discharge device according to claim 13, wherein the discharge and storage block comprises:

a storage block including the recessed portion; and a discharge block including the metering chamber and the switching valve, the nozzle being coupled to the discharge block, wherein the storage block and the discharge block are detachably coupled to each other.

18. The liquid discharge device according to claim 17, wherein the recessed portion is disposed near a coupling portion coupling the discharge block and the storage block.

19. The liquid discharge device according to claim 18, wherein the connection flow path is formed to pass through the coupling portion coupling the discharge block and the storage block.

20. The liquid discharge device according to claim 13, wherein the discharge and storage block includes a fitting portion, the storage unit includes a tubular member detachably fitted to the fitting portion, and the recessed portion and the tubular member constitute the storage container.

21. The liquid discharge device according to claim 13, wherein a distance between the metering chamber and the recessed portion in the horizontal direction is 10 cm or less.

* * * * *